US008369756B2

(12) United States Patent
Kosako et al.

(10) Patent No.: US 8,369,756 B2
(45) **Date of Patent: *Feb. 5, 2013**

(54) IMAGE FORMING APPARATUS, IMAGE FORMING METHOD, AND COMPUTER PROGRAM PRODUCT

(75) Inventors: Jun Kosako, Kanagawa (JP); Shigeyuki Ishii, Tokyo (JP); Takashi Enami, Kanagawa (JP); Nobuyuki Kobayashi, Kanagawa (JP); Natsuko Kawase, Kanagawa (JP); Takahiro Kamekura, Kanagawa (JP); Takahiro Miyakawa, Kanagawa (JP); Miyo Taniguchi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 198 days.

This patent is subject to a terminal disclaimer.

(21) Appl. No.: 12/899,015

(22) Filed: Oct. 6, 2010

(65) Prior Publication Data

US 2011/0085828 A1 Apr. 14, 2011

(30) Foreign Application Priority Data

Oct. 14, 2009 (JP) ..... 2009-237099

(51) Int. Cl.
*G03G 15/01* (2006.01)

(52) U.S. Cl. ..... 399/301; 399/46; 399/49; 399/66; 399/302; 399/308

(58) Field of Classification Search ..... 399/46, 399/49, 66, 301, 302, 308
See application file for complete search history.

(56) References Cited

U.S. PATENT DOCUMENTS

| | | | | |
|---|---|---|---|---|
| 5,515,145 | A * | 5/1996 | Sasaki et al. | 399/302 |
| 6,070,041 | A * | 5/2000 | Nakayasu et al. | 399/301 |
| 2004/0101332 | A1 * | 5/2004 | Sohmiya et al. | 399/307 |
| 2007/0242986 | A1 * | 10/2007 | Matsuyama et al. | 399/301 |
| 2010/0129103 | A1 * | 5/2010 | Ogata et al. | 399/66 |
| 2010/0303487 | A1 | 12/2010 | Miyakawa et al. | |
| 2010/0303514 | A1 | 12/2010 | Ishii et al. | |
| 2010/0322679 | A1 * | 12/2010 | Kobayashi et al. | 399/301 |

FOREIGN PATENT DOCUMENTS

| | | |
|---|---|---|
| JP | 4042127 | 11/2007 |
| JP | 2008-90092 | 4/2008 |

* cited by examiner

*Primary Examiner* — Ryan Walsh
(74) *Attorney, Agent, or Firm* — Oblon, Spivak, McClelland, Maier & Neustadt, L.L.P.

(57) ABSTRACT

An image forming apparatus includes: a transfer-sheet conveying member that rotates to convey a transfer sheet; a first image forming unit that directly transfers a color image onto the transfer sheet; an intermediate transfer member that rotates while an image is transferred thereon; a second image forming unit that transfers images onto the intermediate transfer member; a secondary transfer unit that transfers the images on the intermediate transfer member onto the transfer sheet; a measuring unit that measures a surface velocity of the transfer-sheet conveying member and the intermediate transfer member; and a control unit that performs phase matching control by accelerating or decelerating the transfer-sheet conveying member or the intermediate transfer member so as to match a phase of fluctuation of the measured surface velocity of the transfer-sheet conveying member and a phase of fluctuation of the measured surface velocity of the intermediate transfer member.

8 Claims, 10 Drawing Sheets

IMAGE FORMING APPARATUS, IMAGE FORMING METHOD, AND COMPUTER PROGRAM PRODUCT

CROSS-REFERENCE TO RELATED APPLICATIONS

The present application claims priority to and incorporates by reference the entire contents of Japanese Patent Application No. 2009-237099 filed in Japan on Oct. 14, 2009.

BACKGROUND OF THE INVENTION

1. Field of the Invention

The present invention relates to an image forming apparatus, an image forming method, and a computer program product.

2. Description of the Related Art

In recent years, in the field of an electrophotographic color image forming apparatus, there has been proposed an image forming apparatus that uses both a direct transfer method for directly transferring an image formed on a photosensitive element onto a sheet and an indirect transfer method for temporarily transferring images formed on a plurality of photosensitive elements for each color onto an intermediate transfer member so as to superimpose the images one on top of the other and then transfer the superimposed images onto a sheet (see, for example, Japanese Patent Application Laid-open No. 2008-90092).

More specifically, Japanese Patent Application Laid-open No. 2008-90092 discloses a technology in which, as a method of performing alignment between a directly-transferred image and an indirectly-transferred image in the combination-type image forming apparatus as mentioned above, a time required for moving a belt from a primary transfer position, at which images on a plurality of photosensitive elements for each color are transferred onto an intermediate transfer belt, to a direct transfer position is set to be an integral multiple of one rotation cycle of a drive roller that rotates the intermediate transfer belt, whereby misalignment of the transferred images due to the fluctuation of the rotation velocity of the drive roller is minimized.

However, in the technology disclosed in Japanese Patent Application Laid-open No. 2008-90092, consideration is only given to the velocity fluctuation of the intermediate transfer belt, not to the velocity fluctuation of a transfer-sheet conveying belt. Therefore, there is a problem in that it is difficult to improve position accuracy for alignment at the time of performing full-color printing by using both the direct transfer system and the indirect transfer system.

SUMMARY OF THE INVENTION

It is an object of the present invention to at least partially solve the problems in the conventional technology.

According to an aspect of the present invention, there is provided an image forming apparatus including: a transfer-sheet conveying member that rotates to convey a transfer sheet; a first image forming unit that directly transfers a single-color image or images in a plurality of colors onto the transfer sheet that is in a process of being conveyed; an intermediate transfer member that rotates while an image, which is to be transferred onto the transfer sheet that is in the process of being conveyed, is being transferred thereon; a second image forming unit that transfers, onto the intermediate transfer member, images in a plurality of colors except for a color of the image directly transferred by the first image forming unit; a secondary transfer unit that transfers the images transferred onto the intermediate transfer member onto the transfer sheet that is in the process of being conveyed; a measuring unit that measures a surface velocity of each of the transfer-sheet conveying member and the intermediate transfer member for at least one cycle; and a control unit that performs phase matching control by accelerating or decelerating at least one of the transfer-sheet conveying member and the intermediate transfer member so as to match a phase of fluctuation of the measured surface velocity of the transfer-sheet conveying member and a phase of fluctuation of the measured surface velocity of the intermediate transfer member.

According to another aspect of the present invention, there is provided an image forming method implemented by an image forming apparatus that includes a transfer-sheet conveying member that rotates to convey a transfer sheet; a first image forming unit that directly transfers a single-color image or images in a plurality of colors onto the transfer sheet that is in a process of being conveyed; an intermediate transfer member that rotates while an image, which is to be transferred onto the transfer sheet that is in the process of being conveyed, is being transferred thereon; a second image forming unit that transfers, onto the intermediate transfer member, images in a plurality of colors except for a color of the image directly transferred by the first image forming unit; and a secondary transfer unit that transfers the images transferred onto the intermediate transfer member onto the transfer sheet that is in the process of being conveyed, the image forming method including: measuring, by a measuring unit, a surface velocity of each of the transfer-sheet conveying member and the intermediate transfer member for at least one cycle; and performing, by a control unit, phase matching control by accelerating or decelerating at least one of the transfer-sheet conveying member and the intermediate transfer member so as to match a phase of fluctuation of the measured surface velocity of the transfer-sheet conveying member and a phase of fluctuation of the measured surface velocity of the intermediate transfer member.

According to still another aspect of the present invention, there is provided a computer program product including a computer usable medium having computer readable program codes embodied in the medium that when executed causes a computer to execute an image forming method for an image forming apparatus that includes a transfer-sheet conveying member that rotates to convey a transfer sheet; a first image forming unit that directly transfers a single-color image or images in a plurality of colors onto the transfer sheet that is in a process of being conveyed; an intermediate transfer member that rotates while an image, which is to be transferred onto the transfer sheet that is in the process of being conveyed, is being transferred thereon; a second image forming unit that transfers, onto the intermediate transfer member, images in a plurality of colors except for a color of the image directly transferred by the first image forming unit; and a secondary transfer unit that transfers the images transferred onto the intermediate transfer member onto the transfer sheet that is in the process of being conveyed, the program codes when executed causing a computer to execute: measuring a surface velocity of each of the transfer-sheet conveying member and the intermediate transfer member for at least one cycle; and performing phase matching control by accelerating or decelerating at least one of the transfer-sheet conveying member and the intermediate transfer member so as to match a phase of fluctuation of the measured surface velocity of the transfer-sheet conveying member and a phase of fluctuation of the measured surface velocity of the intermediate transfer member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained in detail below with reference to the accompanying drawings.

An embodiment of the present invention is explained below with reference to FIGS. 1 to 14. The embodiment is an example in which an image forming apparatus is embodied in what is called a color digital multifunction peripheral (hereinafter, simply referred to as an MFP), which has, in combination, a copy function, a facsimile (FAX) function, a print function, a scanner function, a function of distributing an input image (an image of an original read by using the scanner function or an image input by using the FAX function), and the like.

Figure 1:
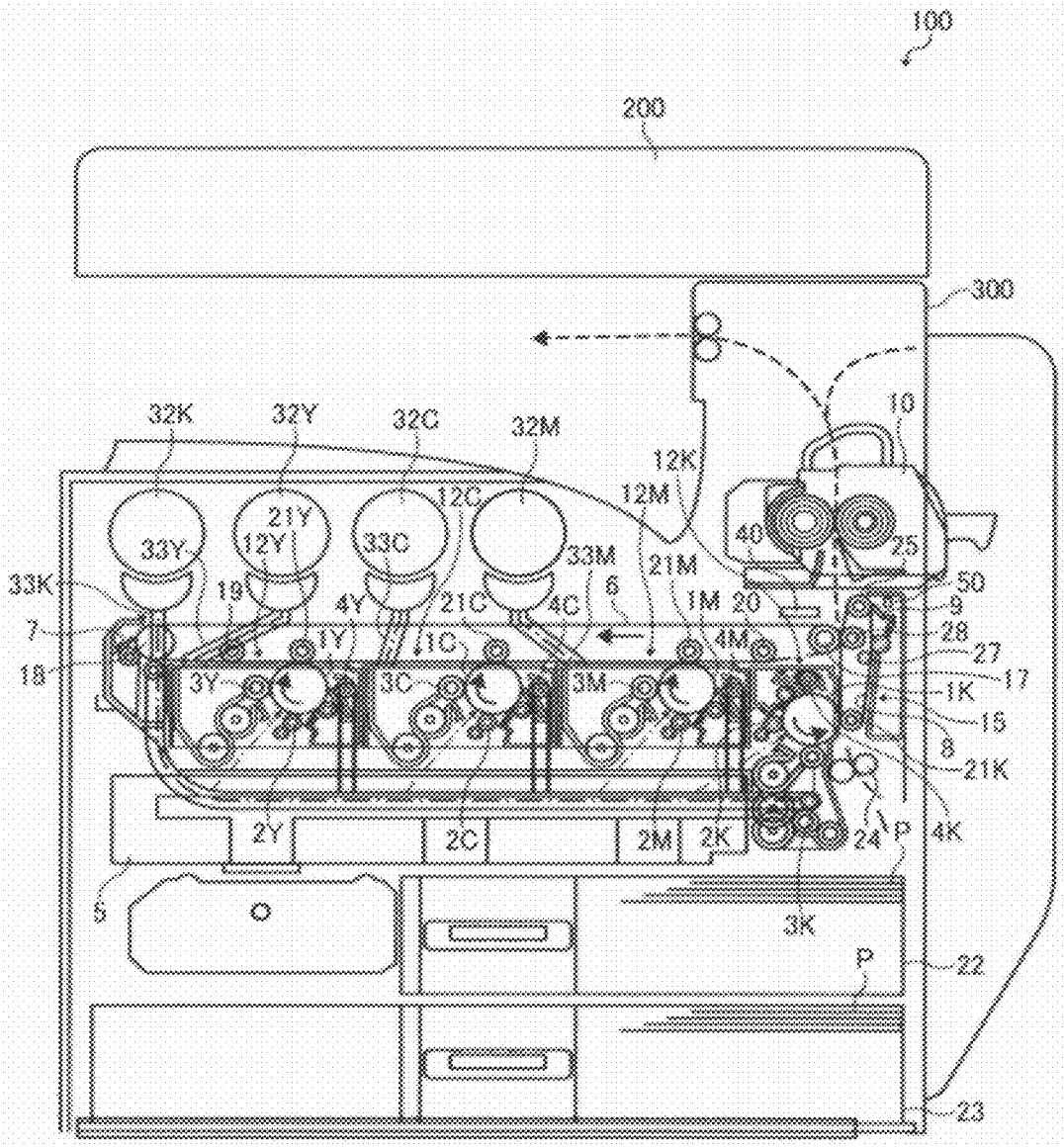
FIG. 1 is a schematic configuration diagram of a multifunction peripheral (MFP) according to an embodiment of the present invention.

FIG. 1 is a schematic configuration diagram of an MFP 100 according to the embodiment of the present invention. As illustrated in FIG. 1, the MFP 100 is made up of a scanner unit 200 that is an image reading device and a printer unit 300 that is an image printing device. The scanner unit 200 and the printer unit 300 constitute an engine control unit 500 (see FIG. 7). The MFP 100 of the embodiment is configured so that a document box function, the copy function, a printer function, and the facsimile function can be selected by switching them from one to another by using an application switch key provided on an operating unit 400 (see FIG. 7). When the document box function is selected, the MFP 100 enters a document box mode; when the copy function is selected, the MFP 100 enters a copy mode; when the printer function is selected, the MFP 100 enters a printer mode; and when the facsimile mode is selected, the MFP 100 enters a facsimile mode.

The printer unit 300 having the characteristic functions of the MFP 100 according to the embodiment is explained in detail below. In the printer unit 300 of the MFP 100, an image forming unit (a first image forming unit) 12K for black (K) is separately arranged. The image forming unit 12K for black (K) is arranged such that a black toner image is formed and the formed black toner image is directly transferred onto a transfer sheet P that is in the process of being conveyed. More specifically, the image forming unit 12K for black is separated from the transfer structures for colors Y, C, and M that are opposing to an intermediate transfer belt 6, which will be explained later, and the toner image for black (K) formed thereby is directly transferred onto the transfer sheet P by a secondary transfer unit 15 rather than the intermediate transfer belt 6.

The intermediate transfer belt 6 (an intermediate transfer member) extends substantially horizontally in a loop and rotates in the extending direction of the intermediate transfer belt 6 while a toner image, which is to be transferred onto the transfer sheet P, is transferred thereon. In the embodiment, the intermediate transfer belt 6 is supported by a drive roller 17, a follower roller 18, and tension rollers 19 and 20. A cleaning unit 7 that removes residual toner from the intermediate transfer belt 6 is arranged on the outer side of the intermediate transfer belt 6 so as to be opposed to the follower roller 18.

In addition, as illustrated in FIG. 1, the printer unit 300 has a tandem system in which three image forming units (a second image forming unit) 12Y, 12C, and 12M are serially arranged in the belt-moving direction along the intermediate transfer belt 6, whereby toner images for yellow, cyan, and magenta (hereinafter, abbreviated as Y, C, M, respectively) (images in a plurality of colors except for the color of the image directly transferred by the image forming unit 12K) are formed and the formed toner images for colors Y, C, and M are transferred onto the intermediate transfer belt 6.

As illustrated in FIG. 1, the printer unit 300 further includes the secondary transfer unit 15 that is arranged such that it substantially vertically intersects with the intermediate transfer belt 6 extending substantially horizontally and is located at a position on the conveying path of the transfer sheet P, i.e., a position where a plurality of color images transferred (superimposed) on the intermediate transfer belt 6 is transferred onto the transfer sheet P on which a black toner image has been directly transferred. In the embodiment, the image forming unit 12K for black is arranged near and along the substantially vertical conveying path of the transfer sheet P, and the secondary transfer unit 15 is arranged in a space on the upstream side of a fixing device 10 on the substantially vertical conveying path.

Figure 2:
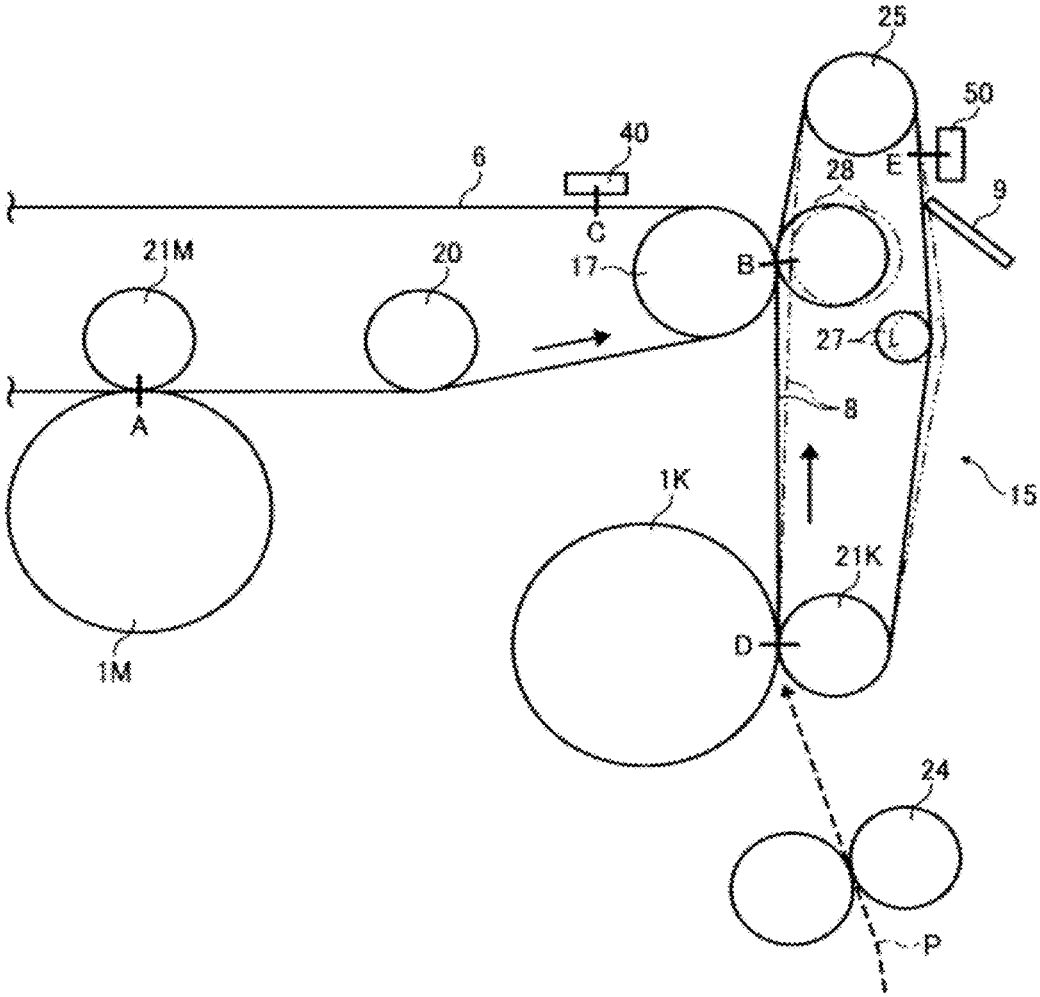
FIG. 2 is a schematic diagram illustrating a general configuration of a secondary transfer unit.

FIG. 2 is a schematic diagram illustrating a general configuration of the secondary transfer unit 15. As illustrated in FIG. 2, the secondary transfer unit 15 includes a transfer-sheet conveying belt 8 that rotates in its extending direction so as to convey the transfer sheet P, a drive roller 25 that supports the transfer-sheet conveying belt 8, a follower roller 21K that also functions as a transfer unit, a tension roller 27, a secondary transfer roller 28 that is a secondary transfer unit, a cleaning unit 9 that cleans the transfer-sheet conveying belt 8, and the like. The secondary transfer roller 28 is arranged opposite to the drive roller 17 of the intermediate transfer belt 6, and can be brought close to or separated from the intermediate transfer belt 6 by a contact/separate mechanism not illustrated. The secondary transfer roller 28 is brought close to the intermediate transfer belt 6 so that toner images for colors Y, C, and M, which have been transferred on the intermediate transfer belt 6, are transferred onto the transfer sheet P conveyed by the transfer-sheet conveying belt 8, at a secondary transfer position B at which the transfer-sheet conveying belt 8 and the intermediate transfer belt 6 come into contact with each other. In the embodiment, the circumferential length of the transfer-sheet conveying belt 8 is identical to the circumferential length of the intermediate transfer belt 6.

The secondary transfer unit 15 according to the embodiment is configured to displace the secondary transfer roller 28; however, the present invention is not limited thereto and the entire transfer-sheet conveying belt 8 may be displaced by using the follower roller 21K as a supporting point.

Conventionally, a configuration has been known in which an intermediate transfer belt is separated from image carriers for colors except for black during formation of monochrome images. In this system, only the intermediate transfer belt is driven and image forming units for colors except for black do not need to be driven (run idle); however, because the intermediate transfer belt is displaced, the problem of tension variation is inevitable. In contrast, if a configuration is made such that the secondary transfer roller is displaced or the entire transfer-sheet conveying belt is displaced, the transfer-sheet conveying belt, which generally has a circumferential length much shorter than that of the intermediate transfer belt, is made in contact or separated while the intermediate transfer belt is allowed to be left unchanged (does not move together with the transfer-sheet conveying belt). Therefore, the tension of the intermediate transfer belt does not vary. That is, although it is possible to employ a configuration in which the intermediate transfer belt, for which alignment needs to be performed at many points, is brought into contact with or separated from the transfer-sheet conveying belt, this configuration may lead to decrease in position accuracy for alignment over time. In contrast, according to the embodiment, because it is possible to employ the configuration in which the intermediate transfer belt 6 is kept in contact with the photosensitive elements (1Y, 1C, 1M) for colors Y, C, and M, positioning accuracy can be maintained high between rollers with respect to the intermediate transfer belt 6, so that the allowance for shifting of the belt can be improved. Furthermore, because the belt can be moved in a stable manner, it is possible to improve the allowance for misalignment (color deviation) during formation of full-color images.

It is also possible to employ a configuration in which the drive roller 17, which supports the intermediate transfer belt 6, is displaced by a unit not illustrated so that the intermediate transfer belt 6 is brought into contact with or separated from the transfer-sheet conveying belt 8. In this case, because the conveying posture of the transfer sheet P does not change, the behavior of the transfer sheet P does not become unstable between the transfer-sheet conveying belt 8 and the fixing device 10. Therefore, it is possible to prevent the occurrence of folding or image distortion of the transfer sheet P discharged by the fixing device 10. It is also possible to employ a configuration in which both the secondary transfer roller 28 in the secondary transfer unit 15 and the drive roller 17 that supports the intermediate transfer belt 6 are moved so that the intermediate transfer belt 6 and the transfer-sheet conveying belt 8 are brought into contact with or separated from each other.

As illustrated in FIG. 2, the printer unit 300 further includes a sensor 40 that is arranged near the intermediate transfer belt 6 and detects, at a pattern detection position C, a pattern 13M (see FIG. 10) that is transferred onto the intermediate transfer belt 6 at a primary transfer position A to measure a surface velocity V1 of the intermediate transfer belt 6. Furthermore, the printer unit 300 also includes a sensor 50 that is arranged near the transfer-sheet conveying belt 8 and detects, at a pattern detection position E, a pattern 13K (see FIG. 10) that is transferred onto the transfer-sheet conveying belt 8 at a primary transfer position D to measure a surface velocity V2 of the transfer-sheet conveying belt 8.

For example, when reflective optical sensors (regular-reflection optical sensors) are used as the sensors 40 and 50, the sensors 40 and 50 irradiate the intermediate transfer belt 6 and the transfer-sheet conveying belt 8 with light and detect the reflected light from the patterns 13M and 13K (hereinafter, referred to as the patterns 13 when they need not be identified) formed on the intermediate transfer belt 6 and the transfer-sheet conveying belt 8, respectively, thereby obtaining information used for measuring the surface velocity of each of the intermediate transfer belt 6 and the transfer-sheet conveying belt 8.

Although the regular-reflection optical sensors are used as the sensors 40 and 50 in the embodiment, the present invention is not limited thereto and a diffusion optical sensor unit may be used that reads light diffused by the patterns 13.

Referring back to FIG. 1, each of the image forming units 12Y, 12C, 12M, and 12K is configured as a process cartridge that is detachably attached to the main body of the printer unit 300. The image forming unit 12 (12Y, 12C, 12M, 12K) includes the photosensitive element 1 (1Y, 1C, 1M, 1K) that is an image carrier, a charging device 2 (2Y, 2C, 2M, 2K), a developing device 3 (3Y, 3C, 3M, 3K) that feeds toner to a latent image to form a toner image, a cleaning device 4 (4Y, 4C, 4M, 4K), and the like. In the image forming units 12Y, 12C, and 12M, the photosensitive elements 1Y, 1C, and 1M are arranged such that they are in contact with the stretched surface of the lower side of the intermediate transfer belt 6. Primary transfer rollers 21Y, 21C, and 21M are arranged as primary transfer units on the inner side of the intermediate transfer belt 6 such that they are opposed to the photosensitive elements 1 (1Y, 1C, 1M).

The printer unit 300 further includes an exposure device 5 that emits laser light, from an LD not illustrated and that corresponds to the image forming unit 12 (12Y, 12C, 12M, 12K) for each color. An original read by the scanner unit 200, data received by a facsimile or the like, or color image information transmitted from a computer is subjected to color separation for each of the colors of yellow, cyan, magenta, and black so as to form data for each color, and the data is sent to the exposure device 5 in the image forming unit 12 (12Y, 12C, 12M, 12K) for each color. The laser light emitted from the LD of the exposure device 5 forms an electrostatic latent image on the photosensitive element 1 (1Y, 1C, 1M, 1K) of the image forming unit 12 (12Y, 12C, 12M, 12K).

Although the blade-type cleaning device 4 is used in the embodiment, the present invention is not limited thereto and a fur-brush roller or a magnetic-brush cleaning system may be used. The exposure device 5 is not limited to a laser system and may be an LED (Light Emitting Diode) system, or the like.

Feed trays 22 and 23 for housing transfer sheets of different sizes are arranged under the printer unit 300, and the transfer sheet P fed from each of the feed trays 22 and 23 by a feed unit, not illustrated, is conveyed to a registration roller pair 24 by a conveying unit not illustrated, so that skew is corrected by the registration roller pair 24 and then the transfer sheet P is conveyed by the registration roller pair 24 to a transfer area between the photosensitive element 1K and the transfer-sheet conveying belt 8 at a predetermined time.

The printer unit 300 further includes a toner bank 32 above the intermediate transfer belt 6. The toner bank 32 is made up of toner tanks 32K, 32Y, 32C, and 32M, and these toner tanks are coupled to the developing devices 3 (3Y, 3C, 3M, 3K) via respective toner feed pipes 33K, 33Y, 33C, and 33M. Because the image forming unit 12K for black is arranged separately from the image forming units 12 (12Y, 12C, 12M) for colors Y, C, and M, transfer toner for colors Y, C, and M does not get mixed during the process of forming black images. Therefore, toner collected from the photosensitive element 1K is conveyed to the developing device 3K for black via a black-toner collection path not illustrated and is then reused. A device that removes paper dust or a device that can switch a path to dispose toner may be arranged along the black-toner collection path.

Figure 3:
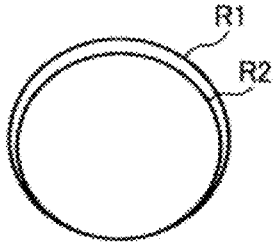
FIG. 3 is a cross-sectional view of a metal mold used for manufacturing a belt.

Next, velocity fluctuation of the belt is explained. FIG. 3 is a cross-sectional view of a metal mold used for manufacturing the intermediate transfer belt 6 and the transfer-sheet conveying belt 8 (hereinafter, each of them is referred to as the belt when it need not be identified). As illustrated in FIG. 3, the mold is formed of an outer frame R1 used for defining the outer diameter (outer circumference) of the belt and a core R2 arranged inside the outer frame R1 and used for defining the inner diameter (inner circumference) of the belt such that rubber is poured into the space between the core R2 and the outer frame R1 so as to be molded into a belt shape. Therefore, when the core R2 is eccentric to the outer frame R1 as illustrated in FIG. 3, the belt cannot have a uniform thickness. When the belt having the non-uniform thickness is rotated by a motor M1 or a motor M2, even if the motor M1 or the motor M2 rotates at an substantially constant velocity, the surface velocity of the belt decreases at a thin portion because the outer circumference of the belt at the thin portion is decreased and the surface velocity of the belt increases at a thick portion because the outer circumference of the belt at the thick portion is increased.

Figure 4:
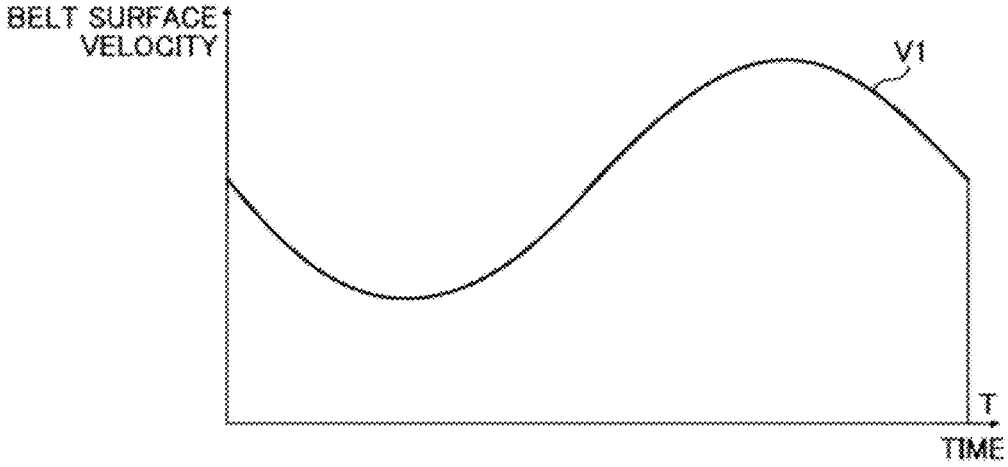
FIG. 4 is a schematic diagram illustrating fluctuation of the surface velocity of an intermediate transfer belt.

FIG. 4 is a schematic diagram illustrating fluctuation of the surface velocity V1 of the intermediate transfer belt 6 when the intermediate transfer belt 6 with the non-uniform thickness as described above is rotated for one cycle. As illustrated in FIG. 4, the surface velocity V1 of the intermediate transfer belt 6 periodically changes in accordance with a trigonometric function based on the thickness change of the belt. A time needed for the intermediate transfer belt 6 to rotate for one cycle is referred to as a period T of the surface velocity V1.

Figure 5:
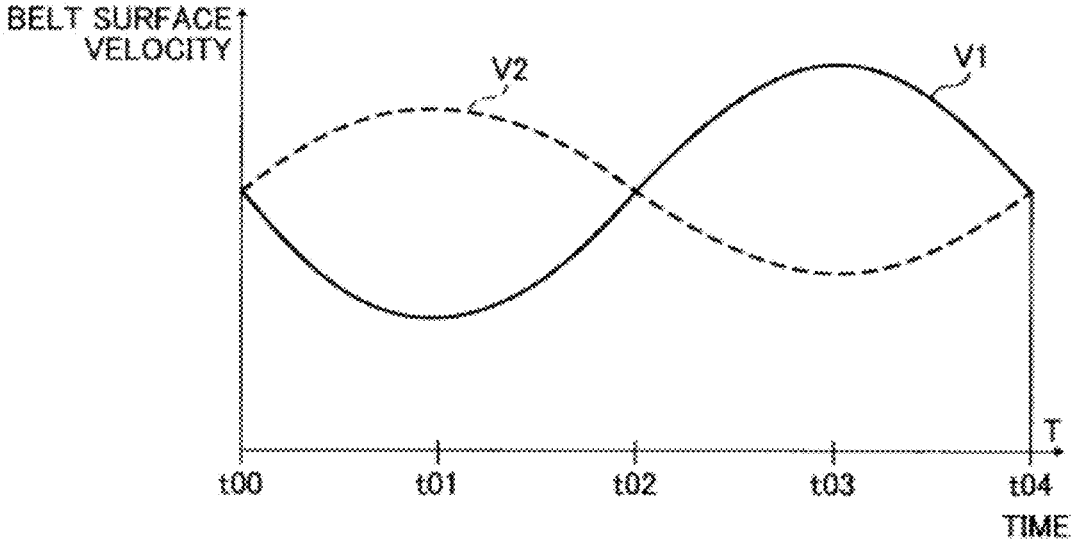
FIG. 5 is a schematic diagram illustrating fluctuation of the surface velocity of each of the intermediate transfer belt and a transfer-sheet conveying belt for one cycle.

Next, the state of the phase of fluctuation of the velocity of each of the intermediate transfer belt 6 and the transfer-sheet conveying belt 8, and a velocity difference between the two belts are explained below. When each of the intermediate transfer belt 6 and the transfer-sheet conveying belt 8 has a non-uniform thickness as described above, a velocity difference between the belts varies depending on the state of the phases of the fluctuation of the velocities of the belts that occurs when the two belts come into contact with each other at the secondary transfer position B (see FIG. 2). FIG. 5 is a schematic diagram for explaining fluctuation of the surface velocity V1 of the intermediate transfer belt 6 and the surface velocity V2 of the transfer-sheet conveying belt 8 for one cycle when the velocity difference between the belts is maximized at the secondary transfer position B (see FIG. 2). In the embodiment, because the belts having identical lengths are used as the intermediate transfer belt 6 and the transfer-sheet conveying belt 8, the period T, which indicates the time needed for each belt to rotate for one cycle, is identical between the intermediate transfer belt 6 and the transfer-sheet conveying belt 8.

In FIG. 5, t01 is a point at which the outer circumference of the intermediate transfer belt 6 is minimum, t03 is a point at which the outer circumference of the intermediate transfer belt 6 is maximum, and t00, t02, and t04 are points at which the midpoint between the point at which the outer circumference is minimum and the point at which outer circumference is maximum passes the secondary transfer position B (see FIG. 2). As illustrated in FIG. 5, as the outer circumference of the intermediate transfer belt 6 slightly decreases from t00 along with the rotation of the belt, the surface velocity V1 continuously decreases until t01. Then, as the outer circumference of the intermediate transfer belt 6 slightly increases from t01, the surface velocity V1 increases until t02 at which it reaches the same surface velocity at t00. Then, the surface velocity V1 keeps increasing until t03, and starts decreasing from t03 until t04 because the outer circumference of the belt starts decreasing at t03.

When the intermediate transfer belt 6 rotates with the velocity fluctuation as described above, and if the velocity fluctuation occurs on the transfer-sheet conveying belt 8 in a period shifted by half with respect to the period of the velocity fluctuation that occurs on the intermediate transfer belt 6, the surface velocity V2 of the transfer-sheet conveying belt 8 increases when the surface velocity V1 of the intermediate transfer belt 6 decreases and the surface velocity V2 decreases when the surface velocity V1 increases as illustrated in FIG. 5, so that a large velocity difference continuously occurs between the two belts.

Figure 6:
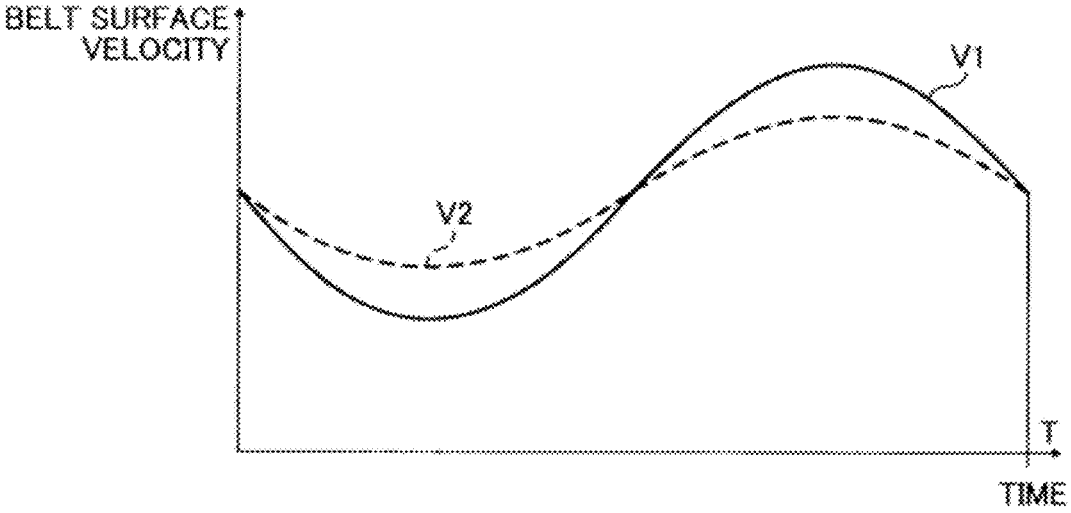
FIG. 6 is a schematic diagram illustrating fluctuation of the surface velocity of each of the intermediate transfer belt and the transfer-sheet conveying belt for one cycle.

On the other hand, FIG. 6 is a schematic diagram for explaining fluctuation of the surface velocity V1 of the intermediate transfer belt 6 and the surface velocity V2 of the transfer-sheet conveying belt 8 for one cycle when the velocity difference between the belts is minimized at the secondary transfer position B (see FIG. 2). As illustrated in FIG. 6, when the fluctuation of the surface velocity V1 of the intermediate transfer belt 6 is synchronized with the fluctuation of the surface velocity V2 of the transfer-sheet conveying belt 8 such that they periodically change in the same period T in accordance with a trigonometric function of the same phases, the velocity difference between the two belts at the secondary transfer position B is minimized.

The image forming apparatus according to the embodiment is characterized in that, as illustrated in FIG. 6, it controls at least one of the surface velocity V1 of the intermediate transfer belt 6 and the surface velocity V2 of the transfer-sheet conveying belt 8 so that the phases of the surface velocity V1 of the intermediate transfer belt 6 and the surface velocity V2 of the transfer-sheet conveying belt 8 match each other at the secondary transfer position B (see FIG. 2).

Figure 7:
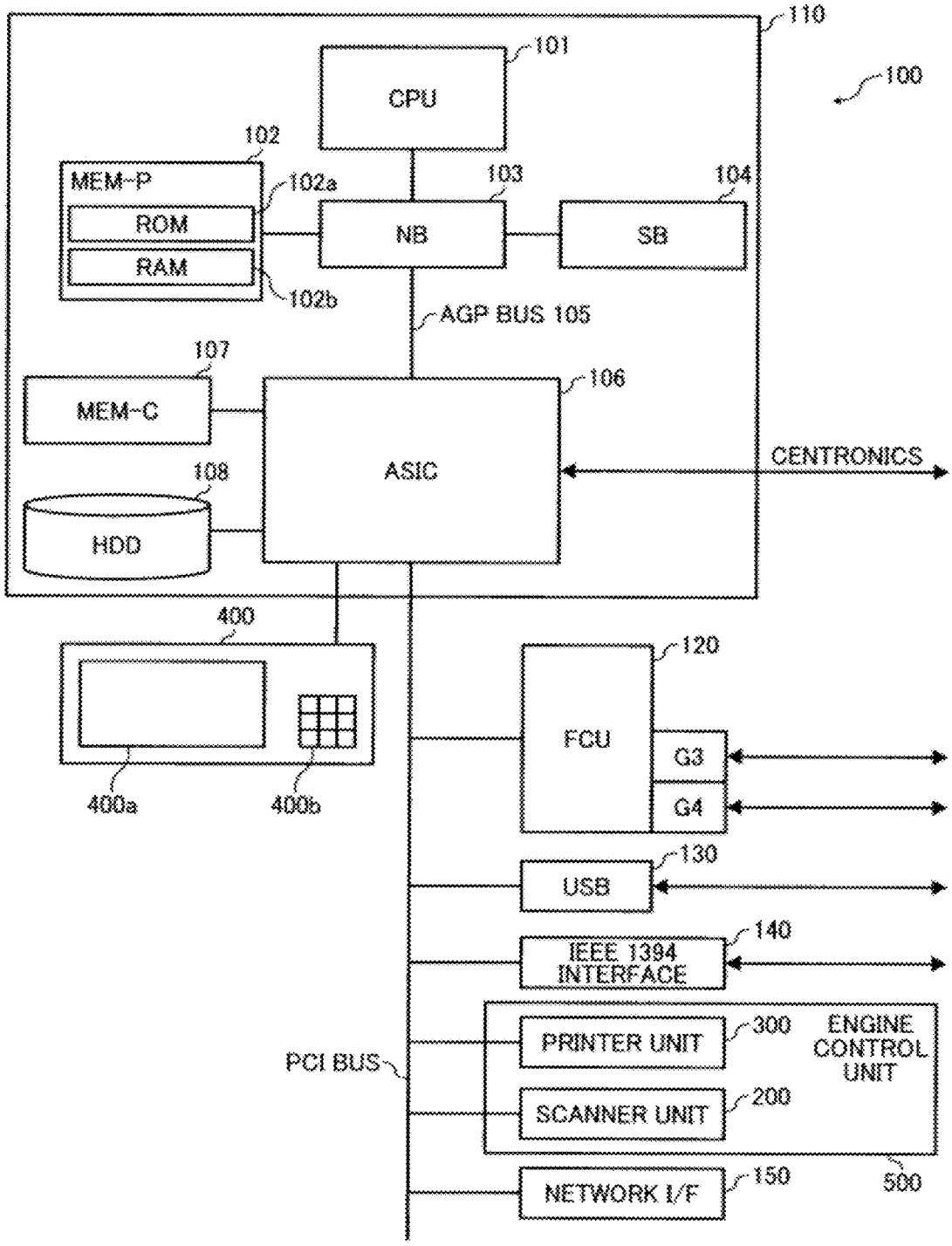
FIG. 7 is a block diagram illustrating a hardware configuration of the MFP.

Next, a hardware configuration of the MFP 100 is explained below. FIG. 7 is a block diagram illustrating hardware configuration of the MFP 100. As illustrated in FIG. 7, the MFP 100 is configured such that a controller 110, the printer unit 300, and the scanner unit 200 are connected to one another via a PCI (Peripheral Component Interconnect) bus. The controller 110 is a controller that controls the whole MFP 100 and controls drawings, communication, and input from the operating unit 400. The printer unit 300 or the scanner unit 200 includes an image processing section for error diffusion, gamma transformation, or the like. The operating unit 400 includes an operation display unit 400*a* that displays, on an LCD (Liquid Crystal Display), original image information or the like on an original read by the scanner unit 200 and receives input from the operator via a touch panel (operational panel), and also includes a keyboard unit 400*b* that receives key input by the operator.

In the MFP 100 of the present embodiment, the document box function, the copy function, the printer function, and the facsimile function can be selected by switching them from one to another by the application switch key on the operating unit 400. When the document box function is selected, the MFP 100 enters a document box mode; when the copy function is selected, the MFP 100 enters a copy mode; when the printer function is selected, the MFP 100 enters a printer mode; and when the facsimile mode is selected, the MFP 100 enters a facsimile mode.

The controller 110 includes a CPU (Central Processing Unit) 101 that is the main part of a computer, a system memory (MEM-P) 102, a north bridge (NB) 103, a south bridge (SB) 104, an ASIC (Application Specific Integrated Circuit) 106, a local memory (MEM-C) 107 that is a storage unit, and a hard disk drive (HDD) 108 that is a storage unit. The NB 103 is connected to the ASIC 106 via an AGP (Accelerated Graphics Port) bus 105. The MEM-P 102 further includes a ROM (Read Only memory) 102*a* and a RAM (Random Access Memory) 102*b*.

The CPU 101 that performs the overall control of the MFP 100 includes a chip set which includes the NB 103, the MEM-P 102, and the SB 104, and the CPU 101 is connected to other devices via the chip set.

The NB 103 is a bridge for connecting the CPU 101 to the MEM-P 102, the SB 104, and the AGP bus 105, and includes a PCI master, an AGP target, and a memory controller that controls reading and writing from and to the MEM-P 102 and the like.

The MEM-P 102 is a system memory used as a memory for storing computer programs and data, a memory for expanding computer programs and data therein, a memory for use in drawing processing performed by the printer, and the like, and includes the ROM 102*a* and the RAM 102*b*. The ROM 102*a* is a read only memory used as a memory for storing computer programs and data for controlling the operation of the CPU 101. The RAM 102*b* is a writable and readable memory used as a memory for expanding computer programs and data therein, a memory for drawing processing performed by the printer, and the like.

The SB 104 is a bridge for connecting the NB 103 to PCI devices and to peripheral devices. The SB 104 is connected to the NB 103 via the PCI bus, to which a network interface (I/F) 150 and the like are also connected.

The ASIC 106, which is an IC (Integrated Circuit) for use in image processing, includes a hardware component for the image processing and functions as a bridge that connects the AGP bus 105, the PCI bus, the HDD 108, and the MEM-C 107 therebetween. The ASIC 106 includes a PCI target and an AGP master, an arbiter (ARB) serving as the core for the ASIC 106, a memory controller that controls the MEM-C 107, a plurality of DMACs (Direct Memory Access Controllers) that control rotation of image data and the like by hardware logic or the like, and a PCI unit that performs data transfer to and from the printer unit 300 and the scanner unit 200 via the PCI bus. An FCU (FAX Control Unit) 120, an USB (Universal Serial Bus) 130, and an IEEE 1394 (the Institute of Electrical and Electronics Engineers 1394) interface 140 are connected to the ASIC 106 via the PCI bus.

The MEM-C 107 is a local memory for use as a copy image buffer and a code buffer. The HDD 108 is a storage for storing image data, computer programs, font data, and forms.

The AGP bus 105 is a bus interface for a graphics accelerator card introduced to speed up graphics operations and allows direct access to the MEM-P 102 with a high throughput, thereby speeding up operations related to the graphic accelerator card.

Computer programs to be executed by the MFP 100 according to the embodiment are provided as being preinstalled in a ROM or the like. The computer programs to be executed by the MFP 100 of the embodiment can be configured so as to be provided as being recorded in a computer-readable recording medium, such as a CD-ROM, a flexible disk (FD), a CD-R, or a DVD (Digital Versatile Disk), in an installable or an executable file format.

The computer programs to be executed by the MFP 100 of the embodiment can be configured so as to be stored in a computer connected to a network such as the Internet so that the computer programs are provided by downloading via the network. The computer programs to be executed by the MFP 100 of the embodiment can also be configured so as to be provided or distributed via a network such as the Internet.

Figure 8:
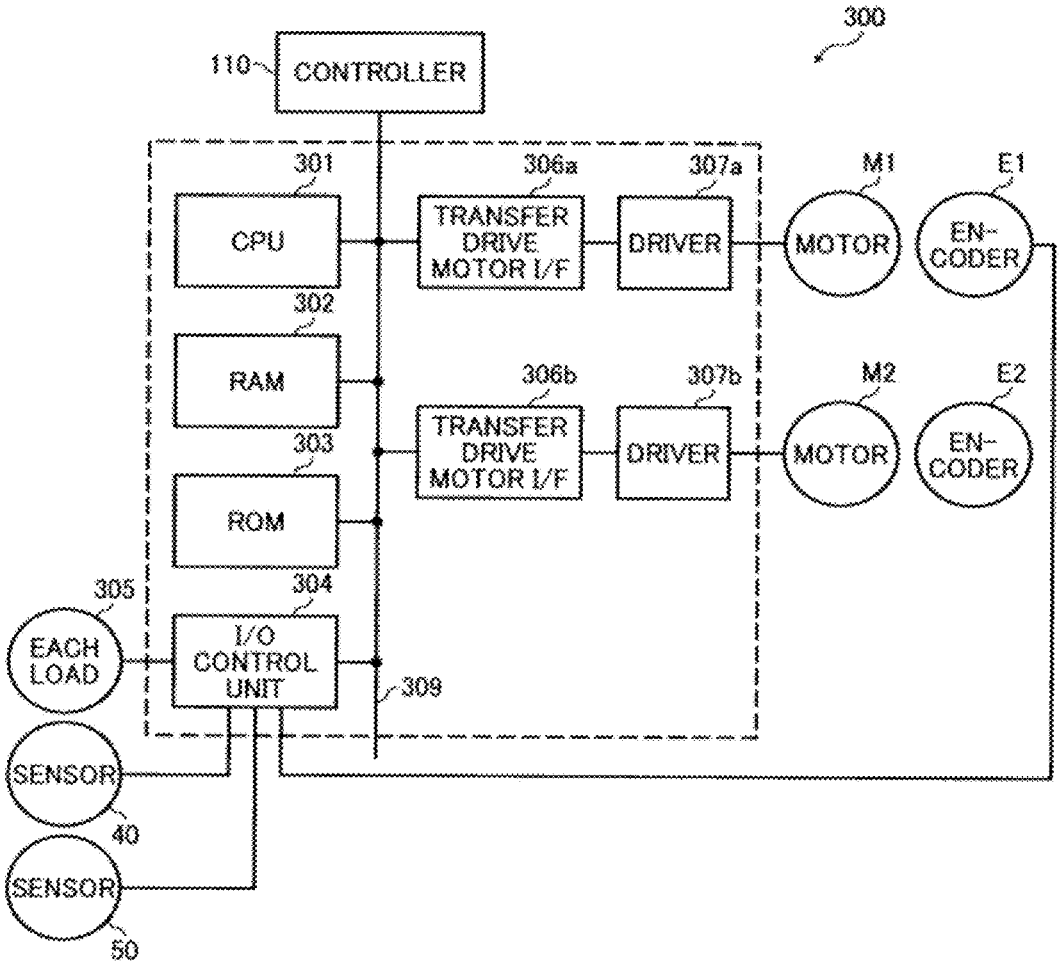
FIG. 8 is a block diagram illustrating a hardware configuration of a printer unit.

FIG. 8 is a block diagram illustrating a hardware configuration of the printer unit 300. As illustrated in FIG. 8, the control system of the printer unit 300 is made up of a CPU 301, a RAM 302, a ROM 303, an I/O control unit 304, a transfer drive motor I/F 306*a*, a driver 307*a*, a transfer drive motor I/F 306*b*, and a driver 307*b*.

The CPU 301 performs overall control of the printer unit 300, including the control of reception of image data input from the controller 110 and transmission and reception of control commands.

The RAM 302 used for works, the ROM 303 used for storing computer programs, and the I/O control unit 304 are connected to one another via a bus 309 so as to execute data read/write processes and various operations performed by a motor, clutch, solenoid, sensor, or the like for driving each load 305, such as a contact/separate mechanism, in response to an instruction by the CPU 301. Further, in response to an instruction by the CPU 301, the RAM 302 used for works, the ROM 303 used for storing programs, and the I/O control unit 304 perform operations of acquiring detection results of the patterns 13M and 13K (see FIG. 10) from the sensors 40 and 50.

In response to a drive command from the CPU 301, the transfer drive motor I/F 306*a* outputs a command signal to the driver 307*a* so as to give an instruction on the drive frequency of a drive pulse signal. A motor M1 is rotated in accordance with the frequency, and an encoder E1 detects the rotation velocity or the rotation drive amount of the motor M1. The drive roller 17 illustrated in FIG. 2 is rotated in accordance with the rotation of the motor M1. Similarly, in response to a drive command from the CPU 301, the transfer drive motor I/F 306*b* outputs a command signal to the driver 307*b* so as to give an instruction on the drive frequency of a drive pulse signal. A motor M2 is rotated in accordance with the frequency, and an encoder E2 detects the rotation velocity and the rotation drive amount of the motor M2. The drive roller 25 illustrated in FIG. 2 is rotated in accordance with the rotation of the motor M2.

The RAM 302 is used as a work area for executing computer programs stored in the ROM 303. Because the RAM 302 is a volatile memory, parameters, such as amplitude or phase values, to be used for a subsequent belt drive are stored in a nonvolatile memory not illustrated such as an EEPROM (Electrically Erasable Programmable Read Only Memory), and data of the surface velocities V1 and V2 for one cycle of the belts is loaded onto the RAM 302 using a sine function or an approximate equation when the power is turned on or the motors M1 and M2 are driven.

The computer programs to be executed by the MFP 100 of the embodiment have a module configuration including each of the units described later (a print control unit 51, an alignment control unit 52, an indirect transfer control unit 53, a direct transfer control unit 54, a secondary transfer control unit 55 (see FIG. 9), and the like) As actual hardware, when the CPU 301 reads and executes the computer programs from the ROM 303, the above units are loaded on a main storage thereby implementing the print control unit 51, the alignment control unit 52, the indirect transfer control unit 53, the direct transfer control unit 54, the secondary transfer control unit 55, and the like on the main storage.

Figure 9:
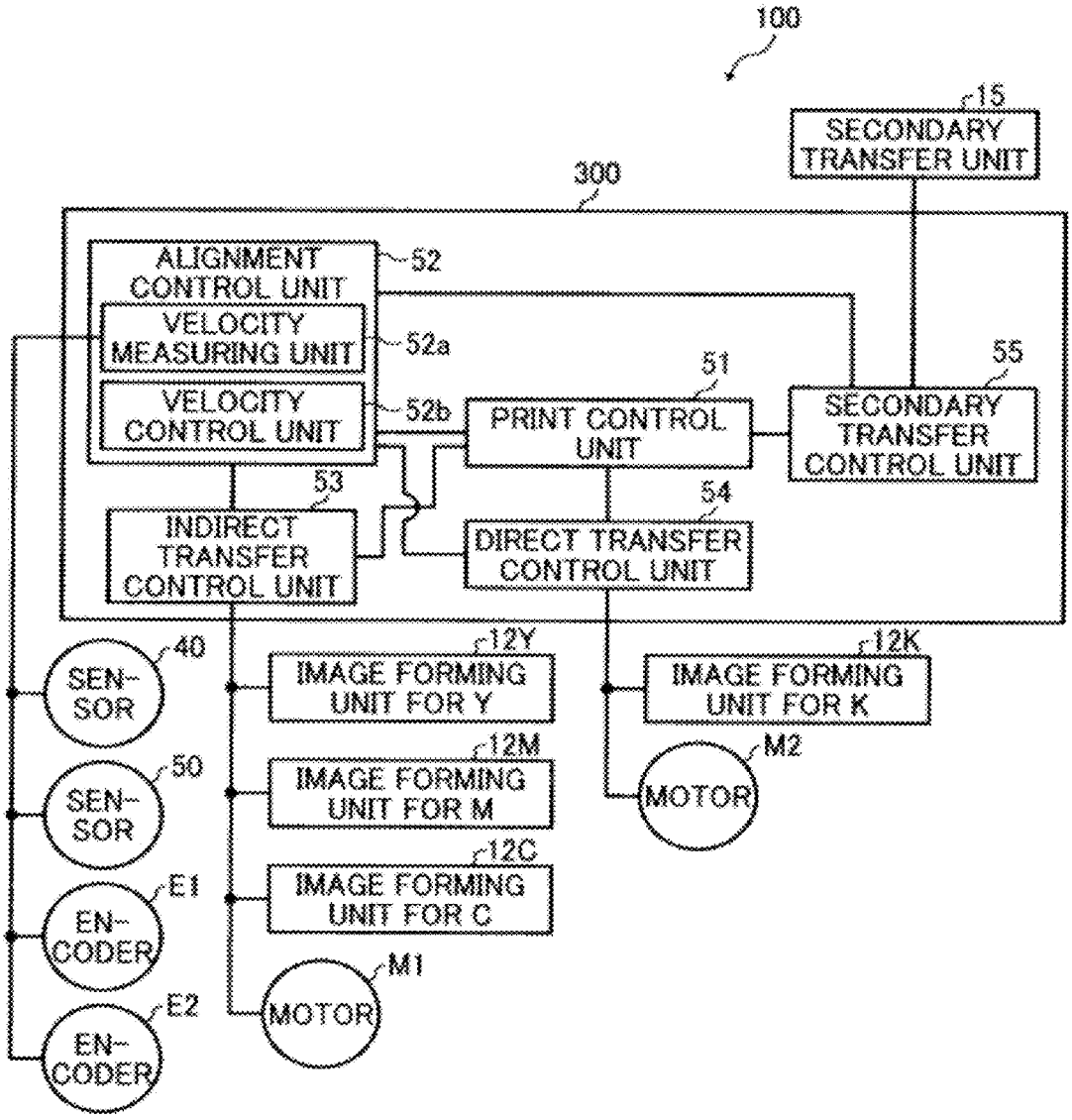
FIG. 9 is a block diagram illustrating a functional configuration of the printer unit.

FIG. 9 is a block diagram illustrating a functional configuration of the printer unit 300. The functional block of FIG. 9 illustrates functions or means implemented by executing the computer programs of the embodiment by the CPU 301. As illustrated in FIG. 9, the CPU 301 mainly includes the print control unit 51, the alignment control unit 52, the indirect transfer control unit 53, the direct transfer control unit 54, and the secondary transfer control unit 55.

The print control unit 51 controls the whole system (the alignment control unit 52, the indirect transfer control unit 53, the direct transfer control unit 54, the secondary transfer control unit 55, and the like) in order to perform full-color printing and black-and-white printing.

The direct transfer control unit 54 controls the image forming unit 12K for color K during the full-color printing and the black-and-white printing so as to form a black toner image to be directly transferred onto the transfer sheet P. More specifically, the direct transfer control unit 54 performs control to cause the photosensitive element 1K of the image forming unit 12K for color K to form a toner image.

In addition, the direct transfer control unit 54 controls the image forming unit 12K for color K so as to form, on the photosensitive element 1K, an image of the pattern 13K (see FIG. 10) to be used for belt phase matching control and so as to transfer the formed pattern 13K onto the transfer-sheet conveying belt 8 at the primary transfer position D (see FIG. 2) at which the photosensitive element 1K and the follower roller 21K come into contact with each other.

The indirect transfer control unit 53 controls the image forming units 12 (12Y, 12C, 12M) for colors Y, C, and M and the intermediate transfer belt 6 during the full-color printing so as to form an image to be transferred onto the transfer sheet P. More specifically, the indirect transfer control unit 53 performs control to cause toner images for colors Y, C, and M formed by the photosensitive elements 1 (1Y, 1C, 1M) of the image forming units 12 (12Y, 12C, 12M) to be superimposed onto the intermediate transfer belt 6 by the indirect transfer system.

In addition, the indirect transfer control unit 53 controls the image forming unit 12M for color M, of which position for transferring an image onto the intermediate transfer belt 6 is closest to the secondary transfer unit 15, and the intermediate transfer belt 6 so as to form, on the photosensitive element 1M, an image of the pattern 13M (see FIG. 10) to be used for the belt phase matching control and so as to transfer the formed pattern 13M onto the intermediate transfer belt 6 at the primary transfer position A (see FIG. 2) at which the photosensitive element 1M and the primary transfer roller 21M come into contact with each other. In the embodiment, the pattern 13M for color M is formed by using the image forming unit 12M for color M; however, the present invention is not limited thereto and it is possible to form the pattern 13 by controlling any one of the image forming units 12Y, 12M, and 12C for colors Y, C, and M.

The secondary transfer control unit 55 functions as a secondary transfer control means, and controls the secondary transfer roller 28 of the secondary transfer unit 15 so as to bring the secondary transfer roller 28 close to or away from the intermediate transfer belt 6. More specifically, during the full-color printing, the secondary transfer control unit 55 brings the secondary transfer roller 28 to a position where images can be transferred onto the transfer sheet P. Accordingly, toner images for colors Y, C, and M, which have been superimposed on the intermediate transfer belt 6 by the indirect transfer system, are transferred onto the transfer sheet P at the position of the secondary transfer roller 28 of the secondary transfer unit 15, i.e., at the secondary transfer position B (see FIG. 2) where the intermediate transfer belt 6 and the transfer-sheet conveying belt 8 come into contact with each other. During the black-and-white printing, the secondary transfer control unit 55 separates the secondary transfer roller 28 from the intermediate transfer belt 6 because there is no need to transfer toner images for colors Y, C, and M onto the transfer sheet P.

Furthermore, when the alignment control unit 52 performs a phase matching control process to be described later, the secondary transfer control unit 55 separates the secondary transfer roller 28 from the intermediate transfer belt 6, and, when the phase matching control process ends, the secondary transfer control unit 55 brings the secondary transfer roller 28 into contact with the intermediate transfer belt 6. Therefore, the velocities of the belts can be adjusted without bringing the transfer-sheet conveying belt 8 and the intermediate transfer belt 6 into contact with each other, so that depletion of the belts due to friction between the belts can be prevented. Furthermore, because the both belts are separated from each other, it is possible to accurately measure the surface velocity of each belt without being affected by the friction between the belts.

The alignment control unit 52 performs alignment of transfer positions for a plurality of colors by a conventionally-known alignment control method so that color deviation between the colors of Y, C, M, and K can be reduced. In the embodiment, the alignment control unit 52 performs the phase matching control process for matching the phase of the surface velocity V1 of the intermediate transfer belt 6 and the phase of the surface velocity V2 of the transfer-sheet conveying belt 8. The alignment control unit 52 includes a velocity measuring unit 52*a* and a velocity control unit 52*b*.

The velocity measuring unit 52*a* functions as a measuring means, and measures the surface velocity V1 of the intermediate transfer belt 6 and the surface velocity V2 of the transfer-sheet conveying belt 8 for at least one cycle (i.e., for one period of the velocity fluctuation) based on the detection results of the patterns 13M and 13K (see FIG. 10) acquired by the sensors 40 and 50 and the I/O control unit 304.

Figure 10:
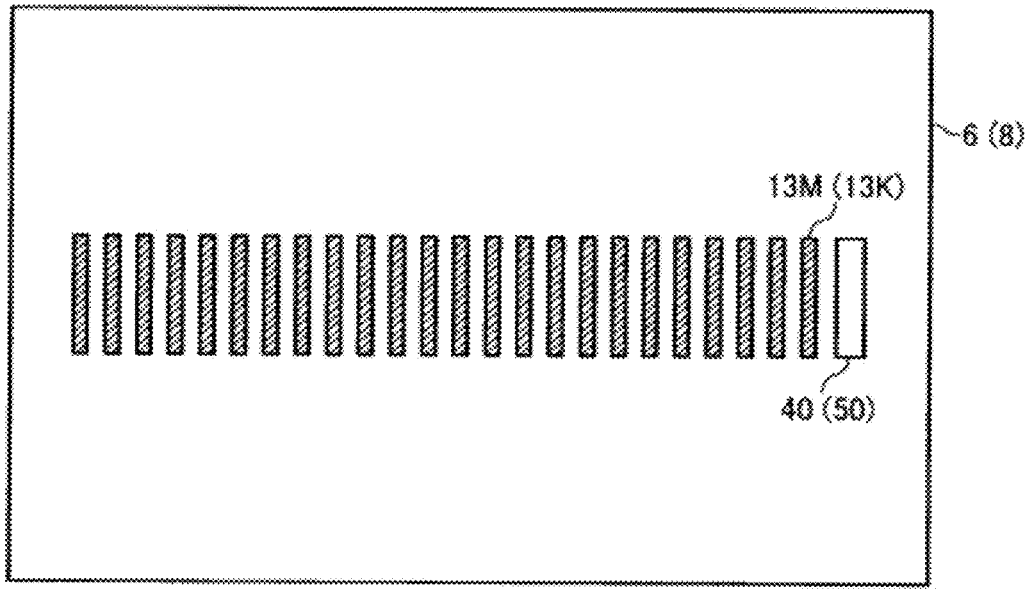
FIG. 10 is a plan view illustrating an example of a pattern.

More specifically, the velocity measuring unit 52*a* forms the patterns 13M and 13K as illustrated in FIG. 10 on the intermediate transfer belt 6 and the transfer-sheet conveying belt 8, respectively, so as to measure the surface velocity V1 of the intermediate transfer belt 6 and the surface velocity V2 of the transfer-sheet conveying belt 8.

FIG. 10 is a plan view illustrating an example of the patterns 13M and 13K. As illustrated in FIG. 10, the patterns 13M and 13K are linear patterns arranged in the center of the intermediate transfer belt 6 and the transfer-sheet conveying belt 8 in their width directions, respectively, at a predetermined interval along a sub-scanning direction. Theses patterns 13M and 13K are formed on the intermediate transfer belt 6 and the transfer-sheet conveying belt 8 along their conveying directions, respectively. More specifically, the indirect transfer control unit 53 controls the image forming unit 12M for color M and the intermediate transfer belt 6 so as to form a toner image of the pattern 13M at a predetermined interval on the photosensitive element 1M, and the formed toner image of the pattern 13M is transferred onto the intermediate transfer belt 6 by the primary transfer roller 21M at the primary transfer position A illustrated in FIG. 2. Also, the direct transfer control unit 54 controls the image forming unit 12K for color K so as to form a toner image of the pattern 13K at a predetermined interval on the photosensitive element 1K, and the formed toner image of the pattern 13K is transferred onto the transfer-sheet conveying belt 8 by the follower roller 21K at the primary transfer position D illustrated in FIG. 2.

As described above, the pattern 13M, transferred onto the intermediate transfer belt 6 at the primary transfer position A, passes through the secondary transfer position B along with the rotational movement of the belt as illustrated in FIG. 2 so as to be conveyed to the pattern detection position C where the pattern 13M is detected by the sensor 40. Similarly, the pattern 13K, transferred onto the transfer-sheet conveying belt 8 at the primary transfer position D, passes through the secondary transfer position B along with the rotational movement of the belt so as to be conveyed to the pattern detection position E where the pattern 13K is detected by the sensor 50. The velocity measuring unit 52*a* measures a time needed for each of the intermediate transfer belt 6 and the transfer-sheet conveying belt 8 to move from a time when each of the sensors 40 and 50 outputs a sensor signal indicating detection of one linear pattern to the I/O control unit 304 to a time when each of the sensors 40 and 50 outputs a sensor signal indicating detection of a next linear pattern to the I/O control unit 304, whereby the surface velocity V1 of the intermediate transfer belt 6 and the surface velocity V2 of the transfer-sheet conveying belt 8 are measured. The patterns 13M and 13K are removed by the cleaning units 7 and 9 after they are detected by the sensors 40 and 50 at the pattern detection positions C and E, respectively. The velocity measuring unit 52*a* continues to form the patterns 13M and 13K during the phase matching control process.

The velocity measuring unit 52*a* needs to match the phase of the surface velocity V1 of the intermediate transfer belt 6 and the phase of the surface velocity V2 of the transfer-sheet conveying belt 8 at a position where the both belts come into contact with each other. Therefore, the velocity measuring unit 52*a* needs to acquire the surface velocities V1 and V2 of the respective belts not at the pattern detection positions C and E (see FIG. 2) where the sensors 40 and 50 detect the patterns 13M and 13K respectively, but at the secondary transfer position B. That is, while the surface velocities of the belts detected by the sensors 40 and 50 are the velocities at the pattern detection positions C and E respectively, it is necessary to compare the surface velocities of the belts at the secondary transfer position B. Furthermore, as illustrated in FIG. 2, because a distance from each of the positions A and D, where the patterns are primary transferred, to the secondary transfer position B, and a distance from the secondary transfer position B to each of the pattern detection positions C and E are generally different between the belts (i.e., AB≠DB and BC≠BE), it is effective to use a ratio between the distances as described above to obtain the surface velocities at the position B.

Therefore, the velocity measuring unit 52*a* calculates, as represented by the following Equations (1) and (2), time tAB and tDB at which the belts pass through the secondary transfer position B based on time tAC and tDE (not illustrated) at which the sensors 40 and 50 start detecting the patterns 13M and 13K respectively, as well as based on a ratio between a distance AC from the primary transfer position A to the pattern detection position C and a distance AB from the primary transfer position A to the secondary transfer position B and a ratio between a distance DE from the primary transfer position D to the pattern detection position E and a distance DB from the primary transfer position D to the secondary transfer position B.

$$tAB(\text{secondary transfer position})=tAC(\text{pattern detection})\times AB/AC \quad (1)$$

$$tDB(\text{secondary transfer position})=tDE(\text{pattern detection})\times DB/DE \quad (2)$$

Figure 11:
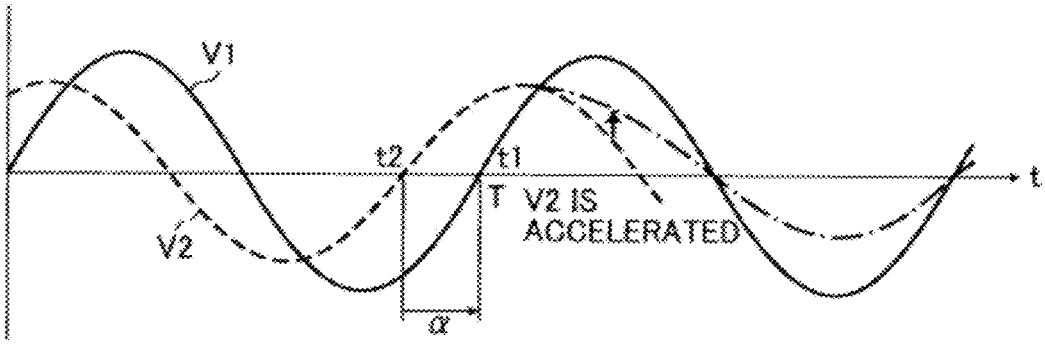
FIG. 11 is a diagram for explaining a case in which the phases of the surface velocities are matched with each other by accelerating the transfer-sheet conveying belt.
Figure 12:
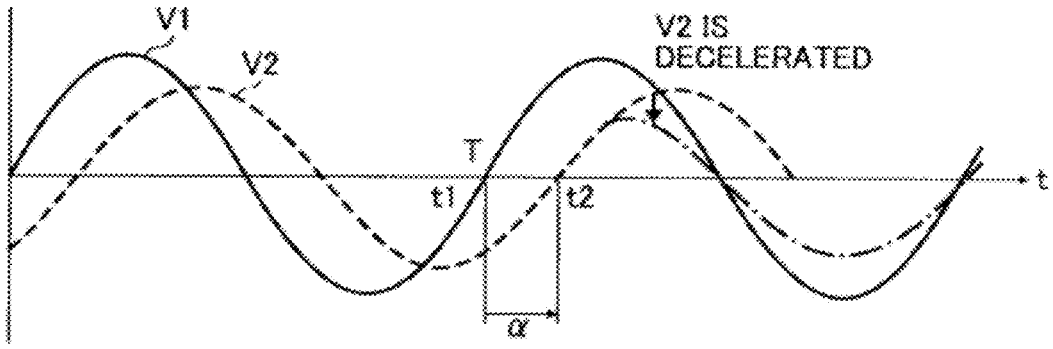
FIG. 12 is a diagram for explaining a case in which the phases of the surface velocities are matched with each other by decelerating the transfer-sheet conveying belt.

In this manner, the velocity measuring unit 52*a* acquires the surface velocities V1 and V2 of the respective belts at the secondary transfer position B (see FIGS. 11 and 12).

In relation to the above Equations, the velocity measuring unit 52*a* calculates the conveying distances AC and DE in which the respective belts are actually conveyed based on the rotation drive amounts of the motors M1 and M2 respectively detected by the encoders E1 and E2 (see FIG. 8). Therefore, even when the thermal expansion occurs on each belt or the outer circumference of each belt changes due to the non-uniform thickness or the like as described above, it is possible to calculate the actual conveyance distances AC and DE.

The velocity measuring unit 52*a* acquires the surface velocities V1 and V2 of the respective belts at the secondary transfer position B (see FIG. 2) at least for one period, and expands the acquired data onto the RAM 102*b*. Then, the velocity measuring unit 52*a* approximates the surface velocities V1 and V2 by trigonometric functions as represented by the following Equations (3) and (4) using phases α1 and α2 and amplitude V01 and V02, respectively.

$$V1=V01\sin(t+\alpha 1) \quad (3)$$

$$V2=V02\sin(t+\alpha 2) \quad (4)$$

In the above descriptions, the velocity measuring unit 52*a* obtains a phase difference α=t1−t2 by comparing the time points t1 and t2 (see FIG. 11) at which the phase α1 of the surface velocity V1 and the phase α2 of the surface velocity V2 of the respective belts becomes 0.

Figure 13:
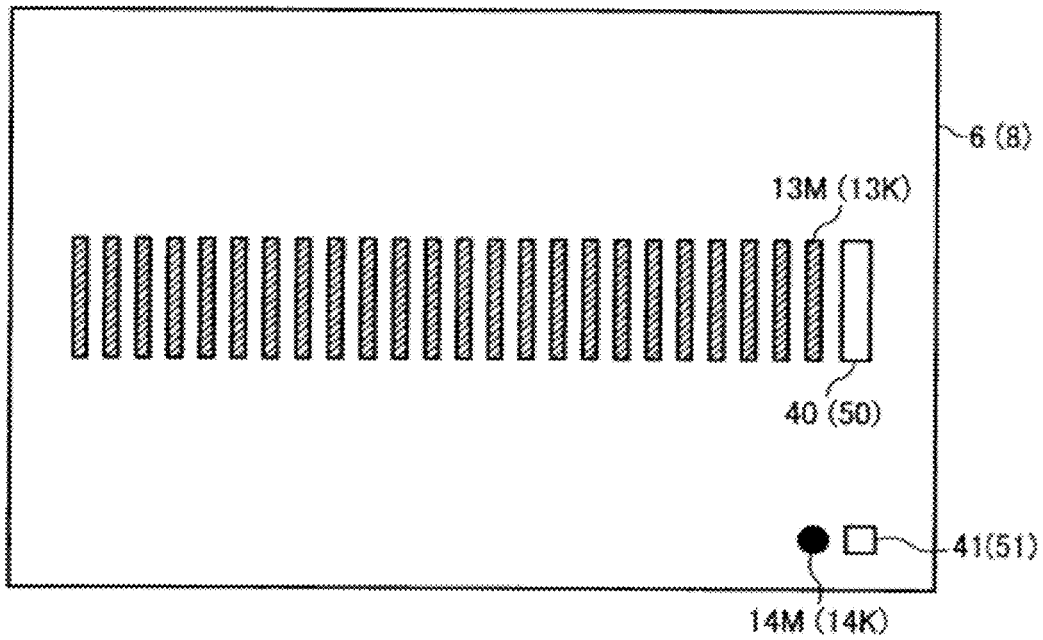
FIG. 13 is a plan view illustrating an example of a mark.

However, the present invention is not limited thereto and it is possible to compare the respective phases based on an arbitrary phase αs. For example, as illustrated in FIG. 13, it is possible to arrange a mark 14M on the intermediate transfer belt 6 in advance and arrange a sensor 41 near the intermediate transfer belt 6 for detecting the mark 14M so as to compare a phase α3 of the surface velocity V1 of the intermediate transfer belt 6 at the time the sensor 41 detects the mark 14M with a phase α4 of the surface velocity V2 of the transfer-sheet conveying belt 8 at the same time, whereby a phase difference α=α3−α4 is obtained. Similarly to the above, it is possible to arrange a mark 14K on the transfer-sheet conveying belt 8 and arrange a sensor 50 near the transfer-sheet conveying belt 8 for detecting the mark 14K so as to determine a time at which a phase difference is to be obtained.

The velocity control unit 52*b* functions as a control means, and accelerates or decelerates at least one of the transfer-sheet conveying belt 8 and the intermediate transfer belt 6 so as to match the phase of the fluctuation of the surface velocity V1 of the intermediate transfer belt 6 and the phase of the fluctuation of the surface velocity V2 of the transfer-sheet conveying belt 8, which are calculated as described above.

More specifically, the velocity control unit 52*b* outputs a command signal to the driver 307*a* via the transfer drive motor I/F 306*a* to perform acceleration control or deceleration control of the rotation velocity of the motor M1. Also, the velocity control unit 52*b* outputs a command signal to the driver 307*b* via the transfer drive motor I/F 306*b* to perform acceleration control or deceleration control of the rotation velocity of the motor M2.

As illustrated in FIG. 11, when, for example, the phase of the surface velocity V2 is delayed by α with respect to the phase of the surface velocity V1, the velocity control unit 52*b* causes the direct transfer control unit 54 to perform the acceleration control of the rotation velocity of the drive motor M2 so as to accelerate the surface velocity V2 of the transfer-sheet conveying belt 8 until the phase difference is eliminated. Alternatively, the velocity control unit 52*b* causes the indirect transfer control unit 53 to perform the deceleration control of the rotation velocity of the drive motor M1 so as to decelerate the surface velocity V1 of the intermediate transfer belt 6 until the phase difference is eliminated.

As illustrated in FIG. 12, when the phase of the surface velocity V2 is preceded by a with respect to the phase of the surface velocity V1, the velocity control unit 52*b* causes the direct transfer control unit 54 to perform the deceleration control of the rotation velocity of the drive motor M2 to decelerate the surface velocity V2 of the transfer-sheet conveying belt 8 until the phase difference is eliminated. Alternatively, the velocity control unit 52*b* causes the indirect transfer control unit 53 to perform the acceleration control of the rotation velocity of the drive motor M1 to accelerate the surface velocity V1 of the intermediate transfer belt 6 until the phase difference is eliminated.

In FIGS. 11 and 12, the phases are matched with each other after the measurement of the surface velocities V1 and V2 for one period is completed and while the belts rotate for the second cycle; however, the present invention is not limited thereto and it is possible to adjust the phases so that they gradually match each other over a plurality of periods.

As described above, when the velocity of one of the belts is controlled, because only one of the motors M1 and M2 needs to be accelerated or decelerated, it is not necessary to operate both the motors, enabling to perform operation with burden on only one of the motors M1 and M2.

The velocity control unit 52*b* can cause both the direct transfer control unit 54 and the indirect transfer control unit 53 to control the motors M1 and M2 respectively, such that one of the surface velocity V1 of the intermediate transfer belt 6 and the surface velocity V2 of the transfer-sheet conveying belt 8 is accelerated and the other is decelerated at the same time until the phase difference is eliminated so as to quickly eliminate the phase difference. Consequently, it is possible to shorten the time needed to perform the phase matching control process, enabling to shorten the downtime in a printing process.

Further, the velocity control unit 52*b* functions as a determining means for determining whether to perform the phase matching control by increasing the velocity of the belt or by only decreasing the velocity of the belt, based on a printing process setting received by the print control unit 51 (a receiving means) from a user via the operating unit 400 (see FIG. 7) and stored in the storage means such as an EEPROM.

That is, when determining that information indicating high-speed printing as the speed of the printing process is set in the storage means, the velocity control unit 52*b* performs the phase matching control process by causing the indirect transfer control unit 53 or the direct transfer control unit 54 to perform the acceleration control on the intermediate transfer belt 6 or the transfer-sheet conveying belt 8. On the other hand, when determining that information indicating normal speed or low-speed printing (high-quality printing) as the speed of the printing process is set in the storage means, the velocity control unit 52*b* performs the phase matching control process by causing the indirect transfer control unit 53 or the direct transfer control unit 54 to perform only the deceleration control on the intermediate transfer belt 6 or the transfer-sheet conveying belt 8 without performing the acceleration control.

With this configuration, because the belts are only decelerated without being accelerated except for when the high-speed printing is set, it is possible to reduce the load on the motors M1 and M2 and lengthen the lifetime of the motors M1 and M2.

Furthermore, when the print control unit 51 (the receiving means) receives a setting related to the processing speed of the phase matching control from a user, the velocity control unit 52*b* gives the highest priority to the seeing received from the user when performing the phase matching control process. That is, when the print control unit 51 receives a setting indicating that "priority is given to the speed of the phase matching control process (and an alignment control process) so as to perform the phase matching control process in the shortest time" from a user, the velocity control unit 52*b* performs the phase matching control process by performing the acceleration control on the intermediate transfer belt 6 or the transfer-sheet conveying belt 8. On the other hand, when the print control unit 51 receives a setting indicating that "priority is not given to the speed of the phase matching control process and only the deceleration control is performed on the motor to give priority to the lifetime of the apparatus", the velocity control unit 52*b* performs only the deceleration control on the belts.

Consequently, it is possible to allow a user to select whether to give priority to the lifetime of the motors M1 and M2 or to give priority to reduction in time of the phase matching control process to improve the productivity of printing. As a result, it is possible to perform the phase matching control process according to a need of the user.

In the above descriptions, the velocity control unit 52*b* determines the contents of the setting related to the acceleration and deceleration of the belts and reflects the determination results in the phase matching control process. However, it is possible to set or receive other settings and reflect these settings in the phase matching control process. For example, it is possible to configure such that the print control unit 51 receives an input about which belt is to be controlled between the intermediate transfer belt 6 and the transfer-sheet conveying belt 8 from a user via the operating unit 400 and then stores the input in the storage means, and the velocity control unit 52*b* specifies the contents of the setting when performing the phase matching control process.

Figure 14:
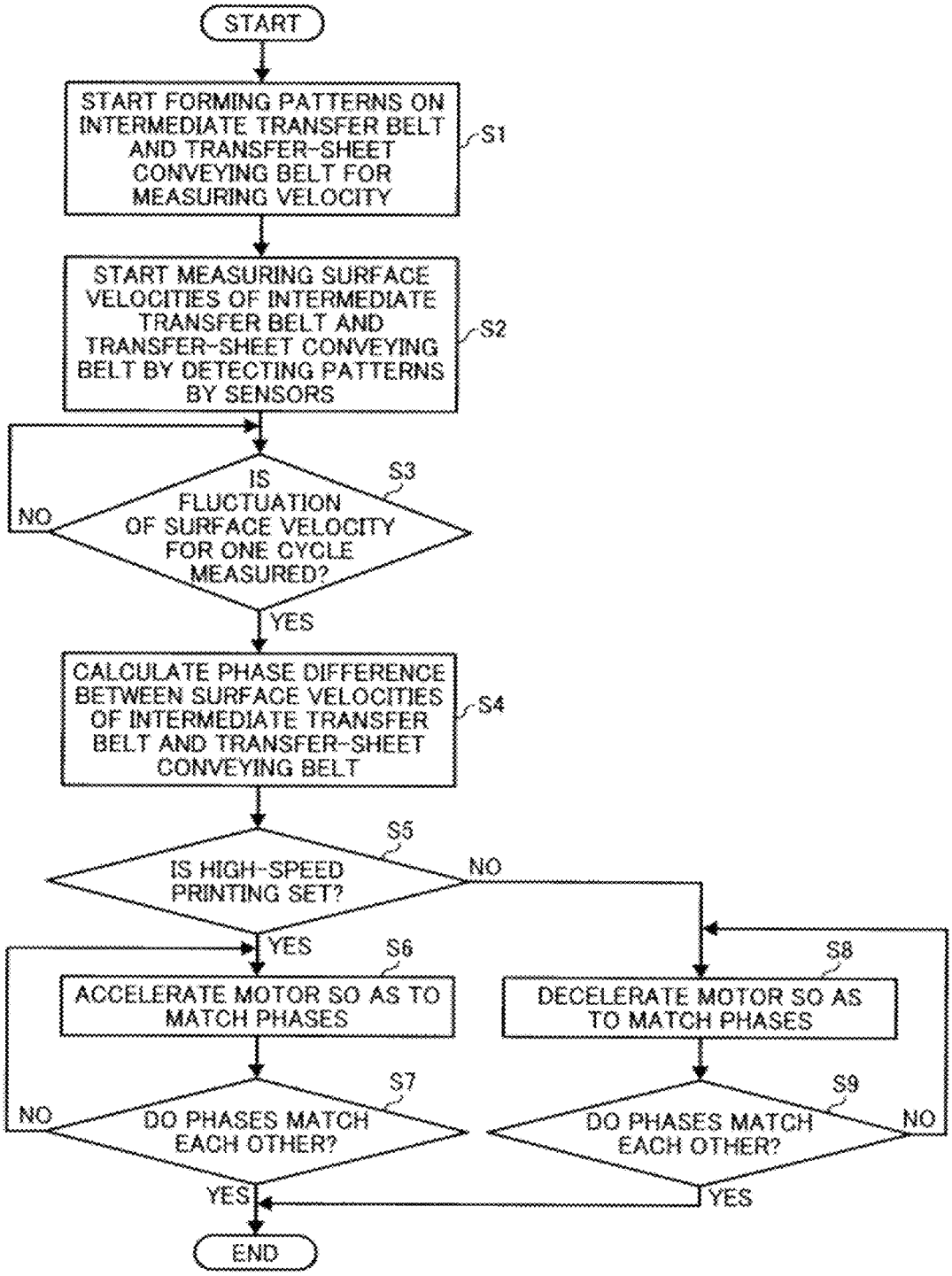
FIG. 14 is a flowchart explaining a procedure of a phase matching control process.

Next, a procedure of the phase matching control process performed by the MFP 100 of the embodiment is described below. FIG. 14 is a flowchart explaining the procedure of the phase matching control process.

The velocity measuring unit 52*a* starts forming the patterns 13M and 13K on the intermediate transfer belt 6 and the transfer-sheet conveying belt 8 to measure the surface velocity V1 of the intermediate transfer belt 6 and the surface velocity V2 of the transfer-sheet conveying belt 8 (Step S1). Then, the velocity measuring unit 52*a* starts detecting the patterns 13M and 13K by using the sensors 40 and 50 to start measuring the surface velocity V1 of the intermediate transfer belt 6 and the surface velocity V2 of the transfer-sheet conveying belt 8 (Step S2). Then, the velocity control unit 52*b* determines whether the surface velocities V1 and V2 for one period are measured (Step S3), and continues the measurement until the surface velocities V1 and V2 for one period are obtained (NO at Step S3). When the data for one period is obtained, the velocity measuring unit 52*a* approximates the surface velocity V1 of the intermediate transfer belt 6 and the surface velocity V2 of the transfer-sheet conveying belt 8 at the secondary transfer position B by the trigonometric function, so that a phase difference is calculated (Step S4).

Then, the velocity control unit 52*b* refers to the settings related to the printing process, which are stored in the storage means (Step S5). When high-speed printing is set (NO at Step S5), the velocity control unit 52*b* performs the acceleration control on one of the motors M1 and M2 to match the phases (Step S6). The velocity measuring unit 52*a* continues measurement of the surface velocities V1 and V2, and determines whether the phases match each other (Step S7). While the phases do not match each other (NO at Step S7), the processes at Step S6 and S7 are repeated.

On the other hand, when the high-speed printing is not set, i.e., when normal speed or low-speed printing (high-quality printing) is set (NO at Step S5), the velocity control unit 52*b* performs the deceleration control on one of the motors M1 and M2 to match the phases (Step S8). The velocity measuring unit 52*a* continues measurement of the surface velocities V1 and V2, and determines whether the phases match each other (Step S9). While the phases do not match each other (NO at Step S9), the processes at Step S8 and S9 are repeated.

When it is determined that the phases match each other at Step S7 or Step S9 (YES at Step S7 or Step S9), the phase matching control process ends.

In this manner, according to the MFP 100 of the embodiment, the velocity control unit 52*b* performs the acceleration control or the deceleration control on at least one of the motors M1 and M2 to accelerate or decelerate at least one of the surface velocity V1 of the intermediate transfer belt 6 and the surface velocity V2 of the transfer-sheet conveying belt 8 so as to match the phase of the fluctuation of the surface velocity V1 of the intermediate transfer belt 6 and the phase of the fluctuation of the surface velocity V2. Therefore, it is possible to minimize a velocity difference between the intermediate transfer belt 6 and the transfer-sheet conveying belt 8. As a result, in the image forming apparatus that uses the direct transfer system and the indirect transfer system in combination, it is possible to improve position accuracy for alignment for all colors.

The MFP 100 of the embodiment can perform the phase matching control process in parallel with a black-and-white printing process by controlling only the velocity of the intermediate transfer belt 6. That is, the velocity measuring unit 52*a* forms the patterns 13M and 13K on the intermediate transfer belt 6 and the transfer-sheet conveying belt 8 in the same manner as described above, measures the surface velocities V1 and V2 of the respective belts in advance, and calculates a phase difference between the velocities. Subsequently, the print control unit 51 causes the secondary transfer control unit 55 to perform separation control to separate the intermediate transfer belt 6 and the transfer-sheet conveying belt 8 from each other. Then, the velocity control unit 52*b* controls the indirect transfer control unit 53 and the motor M1 to perform the acceleration control or the deceleration control of the surface velocity V1 of the intermediate transfer belt 6 so that the calculated phase difference becomes zero. Further, the direct transfer control unit 54 controls the image forming unit 12K for color K and the transfer-sheet conveying belt 8 to form a toner image for K on the photosensitive element 1K, and the formed toner image is transferred onto the transfer sheet P conveyed by the transfer-sheet conveying belt 8.

By adjusting only the velocity of the intermediate transfer belt 6 as described above, it is possible to perform the phase matching control process in parallel with the black-and-white printing. Therefore, it is possible to shorten the downtime in printing, resulting in enhanced convenience.

In the above descriptions, the MFP 100 includes the image forming unit 12K for black as the direct transfer system image forming unit; however, the present invention is not limited thereto and an image forming unit for a different color may be used. Furthermore, it is possible to include a plurality of image forming units, such as an image forming unit for black and an image forming unit for red, as the direct transfer system image forming units to form a single-color image or a multicolor images.

According to one aspect of the present invention, in the image forming apparatus that uses the direct transfer system and the indirect transfer system in combination, it is possible to improve position accuracy for alignment for all colors.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a transfer-sheet conveying member that rotates to convey a transfer sheet;

a first image forming unit that directly transfers a single-color image or images in a plurality of colors onto the transfer sheet that is in a process of being conveyed;

an intermediate transfer member that rotates while an image, which is to be transferred onto the transfer sheet that is in the process of being conveyed, is being transferred thereon;

a second image forming unit that transfers, onto the intermediate transfer member, images in a plurality of colors except for a color of the image directly transferred by the first image forming unit;

a secondary transfer unit that transfers the images transferred onto the intermediate transfer member onto the transfer sheet that is in the process of being conveyed;

a measuring unit that measures a surface velocity of each of the transfer-sheet conveying member and the intermediate transfer member for at least one cycle; and a control unit that performs phase matching control by accelerating or decelerating at least one of the transfer-sheet conveying member and the intermediate transfer member so as to match a phase of fluctuation of the measured surface velocity of the transfer-sheet conveying member and a phase of fluctuation of the measured surface velocity of the intermediate transfer member.

2. The image forming apparatus according to claim 1, wherein a circumferential length of the transfer-sheet conveying member is identical to a circumferential length of the intermediate transfer member.

3. The image forming apparatus according to claim 1, further comprising;

a secondary-transfer control unit that performs control, when the control unit performs the phase matching control, so as to separate the transfer-sheet conveying member and the intermediate transfer member from each other.

4. The image forming apparatus according to claim 1, further comprising:

a determining unit that determines whether high-speed printing is set as printing speed or not, wherein the control unit performs the phase matching control so as to match the phases by accelerating the transfer-sheet conveying member or the intermediate transfer member when the determining unit determines that the high-speed printing is set as the printing speed, and performs the phase matching control so as to match the phases by only decelerating the transfer-sheet conveying member or the intermediate transfer member without any acceleration when the determining unit determines that the high-speed printing is not set as the printing speed.

5. The image forming apparatus according to claim 1, further comprising:

a receiving unit that receives a setting related to processing speed of the phase matching control, wherein the control unit performs the phase matching control so as to match the phases by accelerating at least one of the transfer-sheet conveying member and the intermediate transfer member when the receiving unit receives a setting indicating that priority is given to the processing speed of the phase matching control, and performs the phase matching control so as to match the phases by only decelerating at least one of the transfer-sheet conveying member and the intermediate transfer member without any acceleration when the receiving unit receives a setting indicating that priority is not given to the processing speed of the phase matching control.

6. The image forming apparatus according to claim 1, wherein the control unit performs the phase matching control by accelerating or decelerating the intermediate transfer member in parallel with a printing process which is performed by the first image forming unit and in which a single-color image or images in a plurality of colors are directly transferred onto the transfer sheet.

7. An image forming method implemented by an image forming apparatus that includes a transfer-sheet conveying member that rotates to convey a transfer sheet;

a first image forming unit that directly transfers a single-color image or images in a plurality of colors onto the transfer sheet that is in a process of being conveyed;

an intermediate transfer member that rotates while an image, which is to be transferred onto the transfer sheet that is in the process of being conveyed, is being transferred thereon;

a second image forming unit that transfers, onto the intermediate transfer member, images in a plurality of colors except for a color of the image directly transferred by the first image forming unit; and a secondary transfer unit that transfers the images transferred onto the intermediate transfer member onto the transfer sheet that is in the process of being conveyed, the image forming method comprising:

measuring, by a measuring unit, a surface velocity of each of the transfer-sheet conveying member and the intermediate transfer member for at least one cycle; and performing, by a control unit, phase matching control by accelerating or decelerating at least one of the transfer-sheet conveying member and the intermediate transfer member so as to match a phase of fluctuation of the measured surface velocity of the transfer-sheet conveying member and a phase of fluctuation of the measured surface velocity of the intermediate transfer member.

8. A computer program product comprising a non-transitory computer usable medium having computer readable program codes embodied in the medium that when executed causes a computer to execute an image forming method for an image forming apparatus that includes a transfer-sheet conveying member that rotates to convey a transfer sheet;

a first image forming unit that directly transfers a single-color image or images in a plurality of colors onto the transfer sheet that is in a process of being conveyed;

an intermediate transfer member that rotates while an image, which is to be transferred onto the transfer sheet that is in the process of being conveyed, is being transferred thereon;

a second image forming unit that transfers, onto the intermediate transfer member, images in a plurality of colors except for a color of the image directly transferred by the first image forming unit; and a secondary transfer unit that transfers the images transferred onto the intermediate transfer member onto the transfer sheet that is in the process of being conveyed, the program codes when executed causing a computer to execute:

measuring a surface velocity of each of the transfer-sheet conveying member and the intermediate transfer member for at least one cycle; and performing phase matching control by accelerating or decelerating at least one of the transfer-sheet conveying member and the intermediate transfer member so as to match a phase of fluctuation of the measured surface velocity of the transfer-sheet conveying member and a phase of fluctuation of the measured surface velocity of the intermediate transfer member.

* * * * *